US010267103B2

(12) United States Patent
Rice, II

(10) Patent No.: US 10,267,103 B2
(45) Date of Patent: Apr. 23, 2019

(54) SYSTEM FOR MONITORING PIPE-RETAINING STRUCTURES

(71) Applicant: RICE ELECTRONICS, LP, Houston, TX (US)

(72) Inventor: Hubert Lee Rice, II, Houston, TX (US)

(73) Assignee: RICE ELECTRONICS, LP, Houston, TX (US)

( * ) Notice: Subject to any disclaimer, the term of this patent is extended or adjusted under 35 U.S.C. 154(b) by 0 days.

(21) Appl. No.: 16/020,470

(22) Filed: Jun. 27, 2018

(65) Prior Publication Data

US 2018/0305991 A1 Oct. 25, 2018

Related U.S. Application Data

(63) Continuation of application No. 15/689,717, filed on Aug. 29, 2017, now Pat. No. 10,060,200.

(60) Provisional application No. 62/413,672, filed on Oct. 27, 2016, provisional application No. 62/381,822, filed on Aug. 31, 2016.

(51) Int. Cl.
*G08B 17/00* (2006.01)
*E21B 19/14* (2006.01)

(52) U.S. Cl.
CPC ..... *E21B 19/14* (2013.01)

(58) Field of Classification Search
CPC ..... E21B 19/16; E21B 47/09; E21B 19/14; F16L 3/00; G01D 11/30
USPC ..... 340/686.1, 853.1, 853.2, 853.8, 870.09, 340/870.16; 116/250.1, 345, 323, 83.1; 175/52, 85
See application file for complete search history.

(56) References Cited

U.S. PATENT DOCUMENTS 8,826,988 B2 * 9/2014 Gray ..... E21B 23/04 166/341
9,404,346 B2 8/2016 Gray et al.
(Continued)

FOREIGN PATENT DOCUMENTS

WO 2016075478 5/2016
WO 2018007804 1/2018

OTHER PUBLICATIONS

Copenheaver, Blaine R., "International Search Report and Written Opinion dated Nov. 13, 2017", Patent Cooperation Treaty Application No. PCT/US17/49425, Patent Cooperation Treaty, Nov. 13, 2017.

(Continued)

*Primary Examiner* — Toan N Pham
(74) *Attorney, Agent, or Firm* — Lindauer Law, PLLC

(57) ABSTRACT

Methods for monitoring the movement of latch members using wireless sensors include receiving wireless sensor data that indicates the rate of movement of a latch member toward an open or closed position. Based on correspondence between the rate of movement and latch function data that associates movement rates with functionality and life expectancy of latch members, the health and useable life expectancy of the latch member may be estimated. Additionally, if the movement of the latch member does not fall within threshold minimum and maximum values, or if the movement of a latch does not correspond to a command, output indicating a malfunction may be generated or pipe moving operations associated with the latch member may be canceled.

20 Claims, 10 Drawing Sheets

(56) References Cited

U.S. PATENT DOCUMENTS

| | | | |
|---|---|---|---|
| 2005/0092524 | A1 | 5/2005 | Herst |
| 2010/0104401 | A1 | 4/2010 | Hopkins et al. |
| 2010/0303586 | A1 | 12/2010 | Hankins et al. |
| 2012/0020758 | A1 | 1/2012 | Springett et al. |
| 2012/0038486 | A1 | 2/2012 | Sinclair et al. |
| 2012/0319503 | A1 | 12/2012 | Johnson |
| 2016/0076920 | A1 | 3/2016 | Newton et al. |

OTHER PUBLICATIONS

Finlay, Alan Patrick, "Energy Harvesting From Pressurised Fluids filed Jul. 5, 2016", U.K. Patent Application No. GB1611744.2, The U.K. Intellectual Property Office, dated Jul. 5, 2016.

Finlay, Alan Patrick, "Fingerboard Latch Monitoring filed Jan. 19, 2017", U.K. Patent Application No. GB1700925.9, The U.K. Intellectual Property Office, dated Jan. 19, 2017.

Pham, Toan Ngoc, "Notice of Allowance dated May 7, 2018", "U.S. Appl. No. 15/689,717, The United States Patent and Trademark Office, May 7, 2018."

Salunda Limited, "Integrated Fingerboard Latch Monitor filed Feb. 28, 2017", U.K. Patent Application No. GB1703269.9, The U.K. Intellectual Property Office, Feb. 28, 2017.

Salunda Limited, "Sensor for a Fingerboard Latch Assembly filed Jan. 25, 2017", U.K. Patent Application No. GB1701273.3, The U.K. Intellectual Property Office, dated Jan. 25, 2017.

Salunda Limited, "Sensor for a Fingerboard Latch Assembly filed Nov. 9, 2016", U.K. Patent Application No. GB1618910.2, The U.K. Intellectual Property Office, dated Nov. 9, 2016.

Salunda Limited, "Sensor for a Fingerboard Latch Assembly filed Nov. 9, 2016", U.K. Patent Application No. GB1618935.9, The U.K. Intellectual Property Office, dated Nov. 9, 2016.

Salunda Limited, "Sensor for a Fingerboard Latch Assembly filed Sep. 5, 2016", U.K. Patent Application No. GB1615037.7, The U.K. Intellectual Property Office, dated Sep. 5, 2016.

Salunda Limited, "Sensor for a Rotatable Element filed Apr. 3, 2017", U.K. Patent Application No. GB1705355.4, The U.K. Intellectual Property Office, dated Apr. 3, 2017.

* cited by examiner

SYSTEM FOR MONITORING PIPE-RETAINING STRUCTURES

CROSS-REFERENCE TO RELATED APPLICATIONS

This application claims priority from and the benefit of U.S. patent application Ser. No. 15/689,717, entitled "System for Monitoring Pipe-Retaining Structures", filed Aug. 29, 2017. application Ser. No. 15/689,717 claims priority from and the benefit of the U.S. Provisional Patent Application No. 62/381,822, entitled "Wireless Fingerboard Monitoring Aid and Method", filed Aug. 31, 2016. application Ser. No. 15/689,717 also claims priority from and the benefit of U.S. Provisional Patent Application No. 62/413,672 entitled "Wireless Fingerboard Monitoring Aid and Method", filed Oct. 27, 2016. application Ser. No. 15/689,717, 62/381,822, and 62/413,672 are incorporated by reference herein in their entirety.

BACKGROUND

Drilling pipe, drill collars, and other types of pipes used on an oil rig or other type of drilling site may be suspended from a slotted structure, referred to as a "fingerboard". Latches that span the slots of the fingerboard may be used to retain sets of pipes in a storage position, then opened to allow movement of the pipes. Use of a fingerboard structure may reduce the use of space on a rig floor or other surface of a drilling site for storage of pipes, while use of latches on the fingerboard structure may prevent pipes from falling from the fingerboard structure toward the rig floor, causing potentially catastrophic damage.

BRIEF DESCRIPTION OF FIGURES

The detailed description is set forth with reference to the accompanying figures. In the figures, the left-most digit(s) of a reference number identifies the figure in which the reference number first appears. The use of the same reference numbers in different figures indicates similar or identical items or features.

Figure 1:
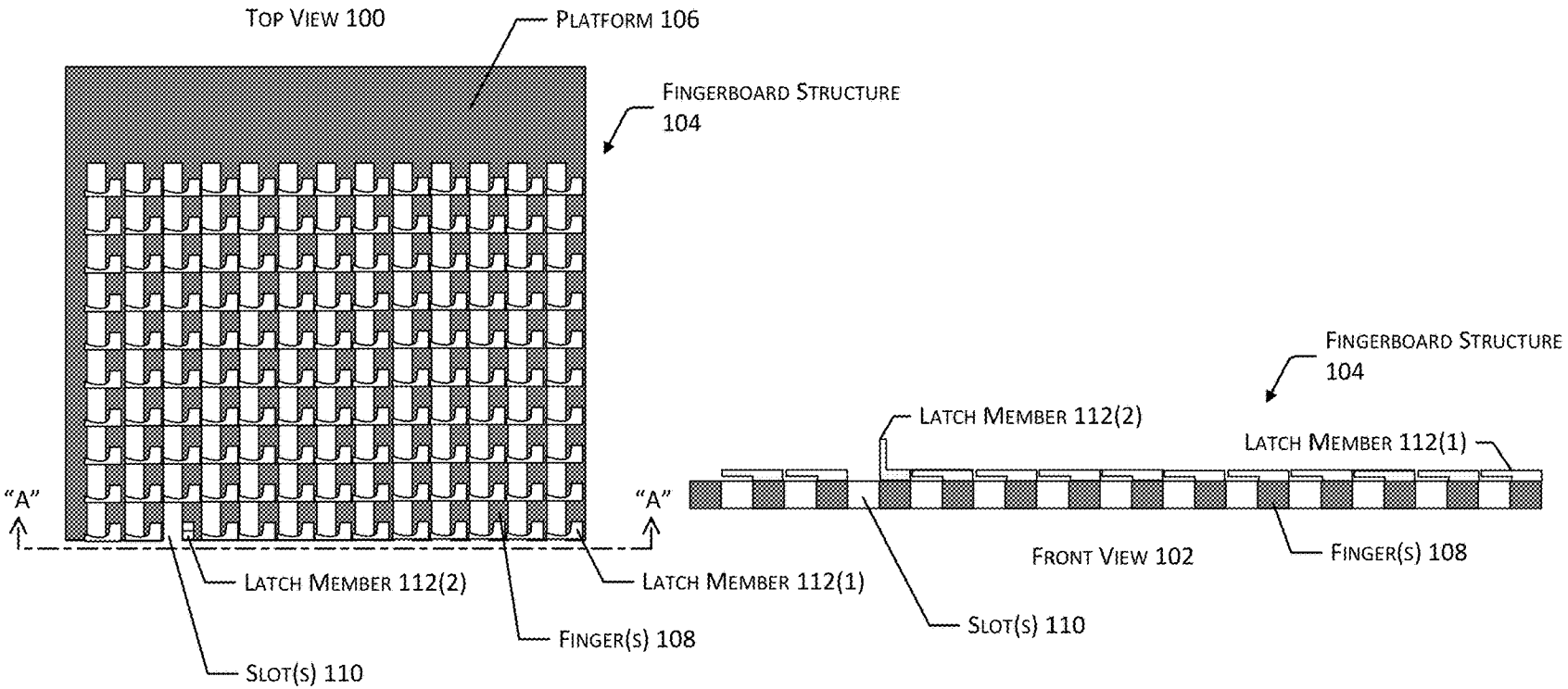
FIG. 1 depicts a top view and a front view of an implementation of a fingerboard structure within the scope of the present disclosure.

While implementations are described in this disclosure by way of example, those skilled in the art will recognize that the implementations are not limited to the examples or figures described. It should be understood that the figures and detailed description thereto are not intended to limit implementations to the particular form disclosed but, on the contrary, the intention is to cover all modifications, equivalents, and alternatives falling within the spirit and scope as defined by the appended claims. The headings used in this disclosure are for organizational purposes only and are not meant to be used to limit the scope of the description or the claims. As used throughout this application, the word "may" is used in a permissive sense (i.e., meaning having the potential to) rather than the mandatory sense (i.e., meaning must). Similarly, the words "include", "including", and "includes" mean "including, but not limited to".

DETAILED DESCRIPTION

One type of structure for storing and securing drilling pipe, drill collars, or other types of pipes for use at an oil rig or other drilling site is known as a "fingerboard". Typically, a fingerboard is suspended above the floor of the drilling site and is engaged with a derrick, mast, or other type of vertical structure. The fingerboard may include a platform from which multiple elongated structures (e.g., "fingers") extend, such that slots are defined between the fingers. The width of the slots may be sized to accommodate passage of the body of a pipe oriented in a vertical position such that a pipe may be prevented from falling due to contact between the wall of the pipe and the fingers. Each slot within a fingerboard may have a length capable of accommodating multiple suspended pipes. Each pipe, or a set of pipes, may be retained within a slot by a moveable latch member. When open, a latch member may permit passage of a pipe into or from the slot, past the latch member. For example, a pipe racker or other type of device for moving pipes may be used to engage and move a pipe into or from a slot when a corresponding latch member is open to permit passage of the pipe. When closed, a latch member may restrict passage of a pipe, which may reduce the likelihood that a pipe may inadvertently fall from the fingerboard. A pipe that falls toward the floor of a drilling site may constitute a catastrophic event that may cause significant damage, injury, or death.

In many cases, a fingerboard platform may be sized to store up to 200 or 300 pipes. Some fingerboard structures may include multiple platforms placed in vertical alignment, and a pipe may pass through multiple platforms, each of which may include a latch for restricting movement of the pipe. As such, a fingerboard structure may include a potentially large number of latch members. A typical latch member may be moved between open and closed positions through use of a pneumatic power source. However, in some cases, especially in a potentially hazardous environment such as a drilling site, pneumatic systems or the latch members themselves may become damaged. If a latch member fails to open, only opens partially, or closes promptly after opening due to a leak in a pneumatic system, the latch member may restrict passage of a pipe when a pipe moving operation using a pipe racker or other type of pipe moving device is undertaken. Attempting to move a pipe through a closed or partially closed latch member using a pipe moving device may damage the fingerboard structure and cause one or more pipes to fall, which may cause potentially catastrophic damage. In some cases, the status of latch members (e.g., whether a latch member is currently open or closed) may be monitored using one or more sensors, such as capacitive or proximity sensors. However, the installation, maintenance, and use of such sensors may be time consuming, costly, and in some cases, inaccurate.

Described in this disclosure are systems and methods for monitoring fingerboards, or other types of structures for retaining pipes, that include use of wireless sensors associated with latch members. While examples described herein may refer to pipes for use at a drilling site, other implementations may be used with any type of solid or hollow object for use at any location, having any shape or size able to be placed within the slots of a fingerboard or other structure that retains objects through use of latch members. Each latch member of a structure may include a wireless sensor associated with the latch member. Example sensors may include linear accelerometers, angular accelerometers, three-dimensional accelerometers, gyroscopes, or other types of devices able to measure a position or movement of a latch member. In some implementations, sensors may also be used to determine vibration of a latch member. In other implementations, sensors may include thermocouples or other types of sensors that may be used to determine a temperature of one or more portions of a latch member. A sensor may communicate wirelessly with a control device via one or more networks. The wireless sensor may transmit sensor data to the control device. The sensor data may indicate a current angular position of the latch, which may include a closed position, an open position, or any position between the closed position and the open position. This sensor data may be used to confirm that a latch member is properly in the closed position when pipes are to be stored, and properly in the open position when it is desired to move one or more pipes into or from the fingerboard structure. For example, if the sensor data indicates that a latch member is in the closed position, in a position between the closed and open positions, or otherwise not in the open position, an attempt to move a pipe retained by the latch may fail or cause damage. The sensor data may also indicate a rate of movement of a latch member toward an open position or a closed position. For example, a typical latch member may be configured to move from a closed state to an open state in approximately 250 milliseconds, and from the open position to the closed position in approximately 600 milliseconds. Data indicative of the rate of movement of a latch member may be used to determine the presence or absence of a malfunction, a useable life expectancy of the latch member, and so forth. For example, over time, a pneumatic system associated with a latch member may develop a small leak, causing the latch member to move more slowly toward the open position and more rapidly toward the closed position. Based on the rates of motion associated with the latch member that are measured over time, the useful life expectancy of the latch member may be determined. Additionally, if a leak or other malfunction causes a latch member to move toward the closed position prematurely, an attempt to move a pipe retained by the latch member after the latch member has closed may fail or cause damage. Sensor data indicative of the rate of motion of the latch member may enable such a malfunction to be detected. In some implementations, sensor data may indicate a temperature associated with a latch member. For example, if a hinge or other mobile portion of a latch member has a temperature greater than a threshold value, this may indicate excess friction or damage, which in turn may indicate that a latch member is in need of lubrication or other types of maintenance or repair. In other implementations, sensor data may indicate a rate or frequency of vibration of a latch member during movement toward the open or closed positions. For example, a frequency of vibration that deviates from a threshold value or that is irregular may indicate that a bearing, hinge, or other portion of a latch member is in need of repair or replacement. In still other implementations, sensor data may indicate a count of instances that a latch member was opened, closed, or moved to another position. For example, a notification suggesting inspection, lubrication, or maintenance may be generated after a latch member has opened and closed one thousand times.

In response to sensor data indicating that a latch member is not fully open subsequent to providing a command to cause the latch member to open, a notification may be generated to cause cancellation of an operation to move the pipe or other object retained by the latch member. In some implementations, a notification indicative of a malfunction associated with the latch member may also be generated. Similarly, in response to sensor data indicating that a latch member is moving toward the open position or toward the closed position, responsive to a command, at a rate less than a threshold rate, output indicative of the functionality or life expectancy of the latch member may be generated. If the movement of the latch member deviates from a threshold value by at least a threshold amount, a notification indicating that a pipe-moving operation associated with the latch member should be cancelled or a notification indicating that the latch member is in need of maintenance, repair, or replacement may be generated. In response to sensor data that a latch member is moving in the absence of a command, such as by falling toward the closed position due to a leak in a pneumatic system, a notification to cause an operation to move a pipe or other object retained by the latch member to be canceled, and a notification indicating that the latch member is in need of maintenance, repair, or replacement may be generated.

In some implementations, secondary detection mechanisms may be used to verify the position of one or more latch members. For example, one or more cameras may be positioned to acquire image data associated with at least a subset of the latch members in a fingerboard. In some cases, a camera may be positioned in association with a pipe racker or other pipe-moving device proximate to the latch members. Image data acquired by a camera may be compared with threshold image data indicative of a latch in a closed position or an open position to verify that a particular latch member is in the open or closed position.

To prolong the useable life of a battery or other power source used in conjunction with the sensors, in some implementations, the sensors may be configured to enter a low power state until movement of a latch member or another event is detected. For example, a sensor may be configured to remain in a low power state until angular movement of a latch member that exceeds a threshold quantity of angular movement is detected. At that time, a sensor may transition to an active state to transmit sensor data to a control device. As another example, a sensor may be configured to remain in a low power state until a command to cause movement of a latch member is received, responsive to which the sensor may transition to an active state to monitor movement of the latch member responsive to the command and transmit data indicative of the movement. In some cases, use of a battery associated with a latch member may be minimized during transport and installation of a latch member. For example, a sensor may be configured to maintain a dormant state when the latch member is placed in a selected angular position. Continuing the example, the sensor may be configured to determine the current angular position of the latch member once per day, then return to a dormant state if the current angular position is the selected angular position. The latch member may be transported while in the selected angular position such that the sensor remains in the dormant state. After installation of the latch member, the latch member may be placed in the closed position, or another position other than the selected angular position. After passage of a threshold length of time, the sensor may determine that the latch member is in a position other than the selected angular position and may enter a non-dormant state. In some cases, a sensor may be configured to enter into a dormant state when a signal from a control device is not received for a threshold length of time. For example, if a network gateway accessed by a sensor is deactivated due to the presence of wirelessly detonatable explosive devices at a worksite, the sensors may become dormant and cease wireless transmissions for a selected period of time, such as twenty-four hours. In other cases, a sensor may be configured to enter into a dormant state for a selected period of time upon receipt of a command from a control device.

FIG. 1 depicts a top view 100 and a front view 102 of an implementation of a fingerboard structure 104 within the scope of the present disclosure. The front view 102 depicted in FIG. 1 is a front-end view of the fingerboard structure 104 as illustrated by section line "A", shown in the top view 100. The fingerboard structure 104 may be designed for engagement with a derrick, mast, or other structure at a drilling site. For example, a fingerboard structure 104 may be suspended approximately halfway up the height of a derrick or mast to retain pipes in a generally vertical orientation while minimizing the footprint of the retained pipes. The fingerboard structure 104 may include a platform 106, which may function as a working surface that may support personnel or other objects. One or more elongated members (e.g., fingers 108) may extend from the platform 106, generally parallel to one another, to define slots 110 between adjacent fingers 108. Each slot 110 may have a width sufficient to enable the diameter of a pipe or other elongated object to move longitudinally within the slot 110, while restricting lateral movement of the pipe or object due to contact between the pipe and the fingers 108 adjacent to the slot 110.

Movement of pipes or other objects longitudinally within a slot 110 may be restricted by one or more latch members 112. For example, a finger 108 adjacent to a slot 110 may support the body of a latch member 112, while a latch portion thereof extends across the slot 110. The latch member 112 may be moveable between a closed position, in which the latch member 112 extends across the slot 110 to limit movement of pipes along the slot 110, and an open position, in which the latch member 112 may pivot such that the latch portion thereof does not obstruct the slot 110 to permit passage of pipes or other objects. For example, in FIG. 1, a first latch member 112(1) is shown in the closed position while a second latch member 112(2) is shown in the open position.

While FIG. 1 depicts an example fingerboard structure 104 having fourteen fingers 108 that define thirteen slots 110, other implementations may include fingerboard structures 104 having any number of fingers 108 or slots 110. Additionally, while FIG. 1 depicts the fingerboard structure 104 including ten latch members 112 associated with each slot 110, other implementations may include any number of latch members 112, ranging from a single latch member 112 spanning across each slot 110 to a potentially large number of latch members 112 depending on the length of the slot 110 and the intended sizes of the pipes to be retained in the slot 110. Furthermore, in some implementations, multiple platforms 106 having respective sets of fingers 108 may be positioned in vertical alignment with one another, each of which may include multiple latch members 112. For example, to enable longitudinal movement of a pipe that extends through two fingerboard structures 104, a vertically aligned pair of latch members 112 may be simultaneously caused to open.

Figure 2:
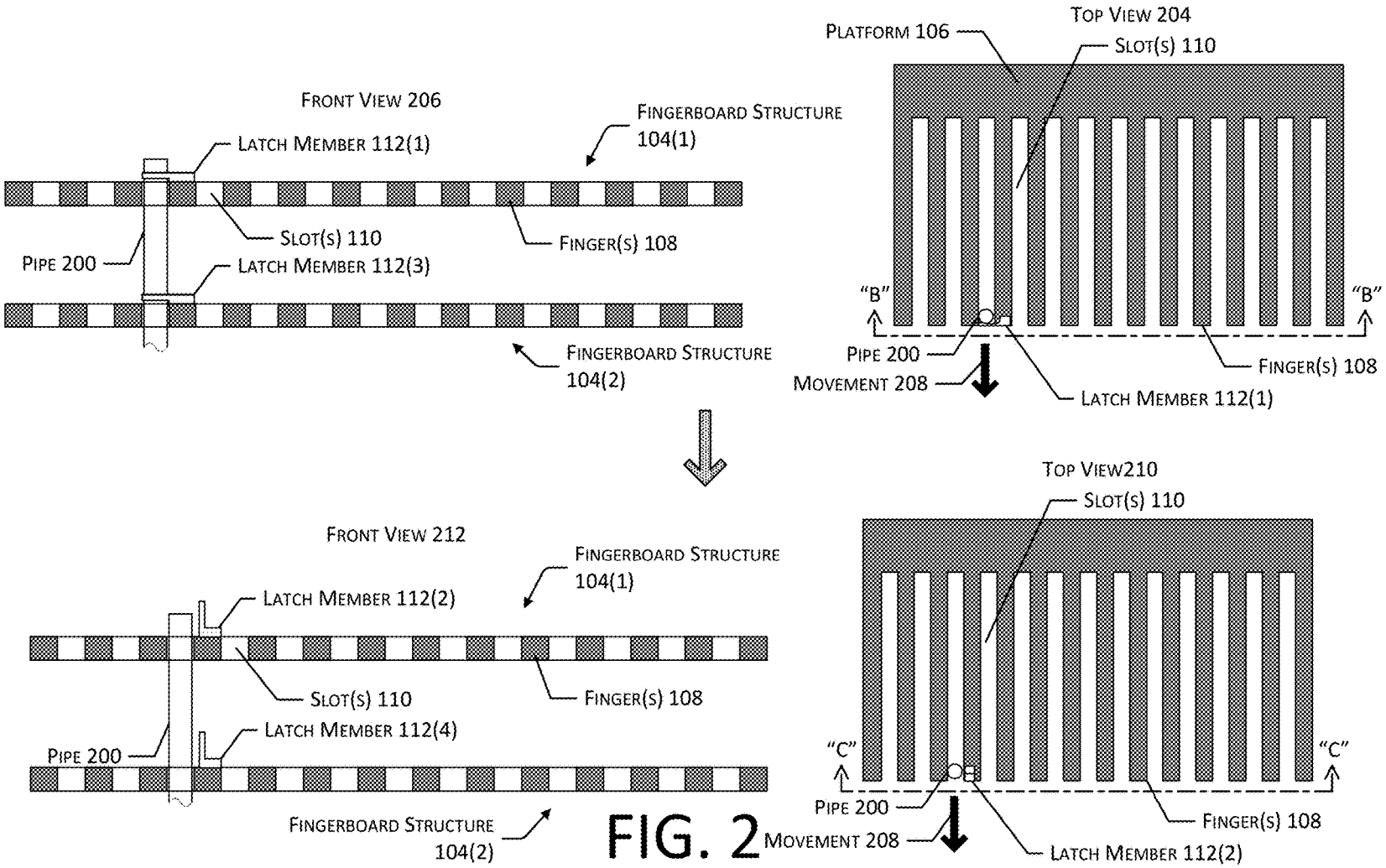
FIG. 2 illustrates movement of a pipe relative to a fingerboard structure based on the position of a latch member.

FIG. 2 illustrates movement of a pipe 200 relative to a fingerboard structure 104 based on the position of a latch member 112. A first top view 204 and front view 206 depict a first fingerboard structure 104(1) having a latch member 112(1) in a closed position and a second fingerboard structure 104(2) having a latch member 112(3) in a closed position. The depicted front view 206 is a front-end view of the fingerboard structures 104, as illustrated by the section line "B", included in the top view 204. The top view 204 and front view 206 depict a single latch member 112 associated with each fingerboard structure 104 for illustrative purposes; however, a fingerboard structure 104 may include any number of latch members 112. When in the closed position, the latch member 112(1) and the latch member 112(3) each span the width of a slot 110, such that a pipe 200 within vertically aligned slots 110 of the fingerboard structures 104 is prevented from movement 208 outward from the slots 110. As such, when the latch member 112(1) and the latch member 112(3) are in the closed position, contact between the latch members 112 and the body of the pipe 200 may limit movement 208 of the pipe 200 outward from the fingerboard structures 104. Contact between another latch member 112 (not shown) or another pipe 200 (not shown) within the slot 110 may limit movement 208 of the pipe 200 toward the platform 106. In some cases, contact between the platform 106 and the pipe 200 may limit movement 208 of the pipe 200 within the slot 110. Lateral movement of the pipe 200 relative to the slot 110 may be limited by contact between the pipe 200 and the fingers 108 adjacent to the slot 110. Additionally, vertical movement of the pipe 200 in a downward direction relative to the fingerboard structure 104 may be limited by contact between a lower end of the pipe 200 and the floor of a worksite. In other implementations, other support members or fasteners may be used to secure the pipe 200 to limit vertical movement of the pipe 200 relative to the fingerboard structure 104.

A second top view 210 and front view 212 depict the first fingerboard structure 104(1) having the latch member 112(2) in an open position and the second fingerboard structure 104(2) having the latch member 112(4) in an open position. The depicted front view 212 is a front-end view taken along section line "C", included in the top view 210. When in the open position, the latch member 112(2) and the latch member 112(4) do not obstruct respective slots 110 of the fingerboard structures 104. In other implementations, the latch members 112 in the open position may partially overlap the width of the respective slots 110, but a distance between the latch members 112 and an adjacent finger 108 may be greater than the width of the pipe 200, such that the pipe 200 may pass the latch members 112 when moved longitudinally within the slots 110. For example, a pipe racker or another type of tool or device configured to move the pipe 200 may engage a portion of the pipe 200 that extends above or below the fingers 108, then pull the pipe 200 outward from the slots 110, imparting movement 208 in the direction indicated by the arrow. Because the latch member 112(2) and the latch member 112(4) are in the open position, the pipe 200 is able to be moved outward from the slot 110 unobstructed by the latch members 112.

Figure 3:
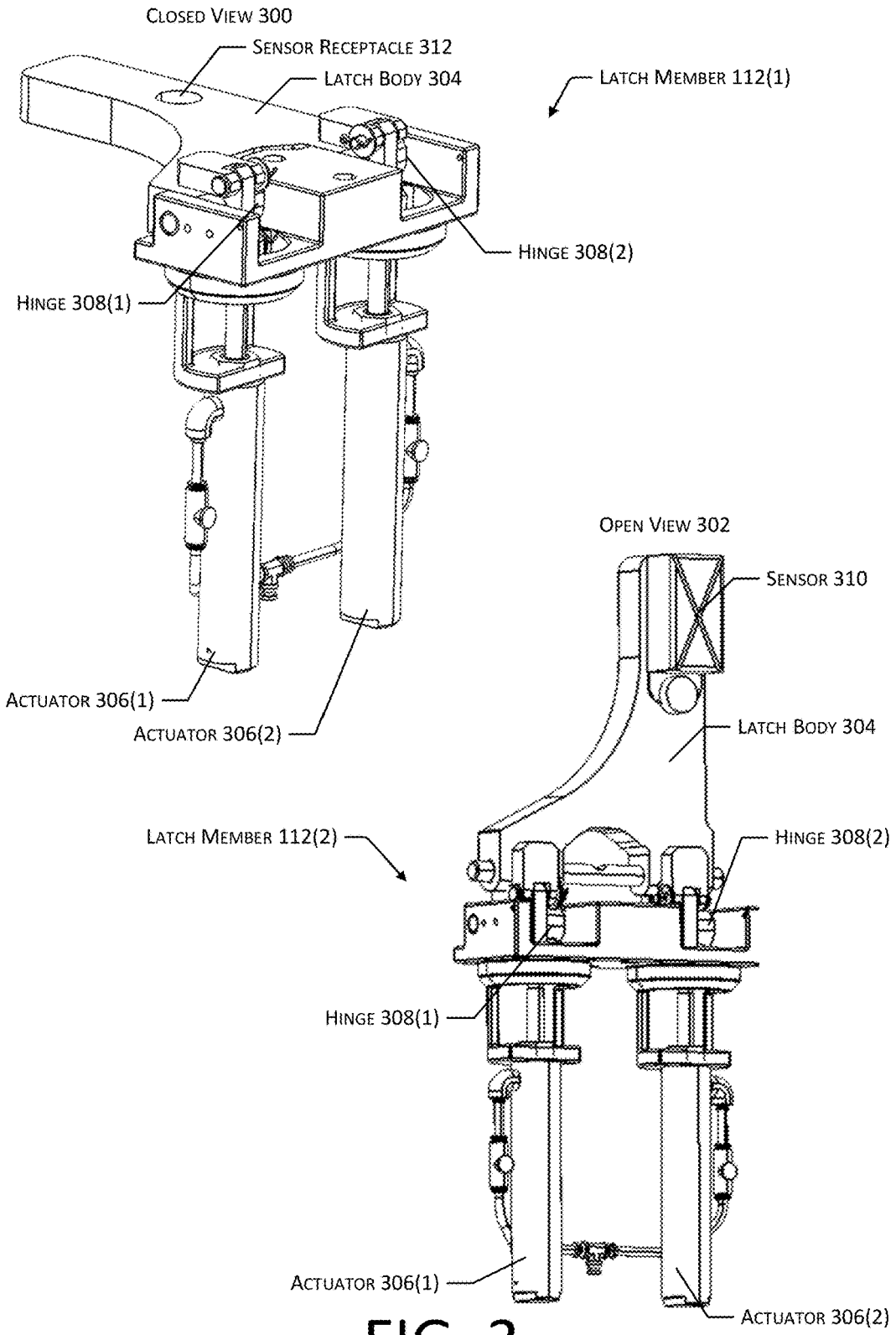
FIG. 3 depicts a closed view and an open view of an implementation of a latch member.

FIG. 3 depicts a closed view 300 and an open view 302 of an implementation of a latch member 112 within the scope of the present disclosure. The latch member 112 may include a latch body 304 engaged with one or more actuators 306 via one or more movable elements, such as hinges 308. The latch body 304 may have a length sized to extend across at least a portion of a slot 110 within a fingerboard structure 104, such that when in the closed position, the latch body 304 limits movement of a pipe 200 or other object longitudinally within the slot 110. In some implementations, the latch body 304 may include one or more curved or arcuate surfaces that are at least partially complementary to the external surface of a pipe 200. The curvature of the arcuate surface may facilitate retention of the pipe 200 due to contact between the arcuate surface and the exterior of the pipe 200.

The latch body 304 may be engaged with one or more actuators 306 via one or more hinges 308. For example, the actuators 306 may include pneumatic cylinders used to apply an angular force to a portion of the latch body 304 that is engaged with the hinge(s) 308. Continuing the example, FIG. 3 depicts a first actuator 306(1) engaged with a first hinge 308(1) and a second actuator 306(2) engaged with a second hinge 308(2). The hinges 308 may be positioned opposite the distal end of the latch body 304, in vertical alignment with the actuators 306. The actuators 306 or another supporting structure may engage the latch member 112 with a finger 108 of the fingerboard structure 104, such that the latch body 304 extends across a slot 110 adjacent to the finger 108 when in the closed position. Application of a force to the latch body 304 by the actuators 306 may cause the latch body 304 to pivot about the hinges 308, moving the latch body 304 from the closed position shown in the closed view 300 toward the open position shown in the open view 302. While the latch member 112(1) is shown having two actuators 306 associated with two hinges 308, other implementations may include any number and any type of actuators 306 and hinges 308 or other mobile features. Additionally, while the latch member 112(1) is shown having a generally L-shaped latch body 304 with a curved or arcuate edge, the latch body 304 may have any shape that at least partially obstructs a slot 110 within a fingerboard structure 104.

While FIG. 3 depicts the latch body 304, when in the closed position, as generally perpendicular to the actuators 306 or other support structure that may be used to secure the latch member 112 to a finger 108, in other implementations, the closed position may include any orientation of the latch body 304 that at least partially obstructs a slot 110 within the fingerboard structure 104 to limit movement of a pipe 200 or other object within the slot 110. Additionally, while FIG. 3 depicts the latch body 304 as generally parallel to the actuators 306 when in the open position, in other implementations, the open position may include any orientation of the latch body 304 that overlaps or obstructs a smaller portion of the slot 110 than that which is obstructed by the latch body 304 when in the closed position.

A sensor 310 may be attached to the latch body 304 or positioned on the latch member 112 in a manner that may enable the sensor 310 to determine a position and rate of movement of the latch body 304. For example, the sensor 310 may be positioned at or near the distal end of the latch body 304 and be secured through engagement of one or more fasteners or portions of the sensor 310 within a sensor receptacle 312 formed in the latch body 304, such that the angular orientation of the latch body 304 and the rate of movement of the latch body 304 between the open and closed positions may be measured. Continuing the example, the sensor 310 may include one or more of a linear accelerometer, an angular accelerometer, a gyroscope, or another similar device capable of determining one or more of the angular position or rate of movement of the latch body 304. While FIG. 3 depicts a single sensor 310 engaged with the latch body 304, in other implementations, any number of sensors 310 may be engaged with any portion of the latch member 112 or positioned in a manner that may enable the sensor(s) 310 to detect or measure movement 208 of the latch body 304. Additionally, while FIG. 3 depicts a sensor receptacle 312 having a generally cylindrical shape, sensor receptacles 312 having any shape may be used. For example, a sensor receptacle 312 having a triangular shape may be configured to engage a triangular-shaped bushing associated with the housing of a sensor 310.

Figure 4:
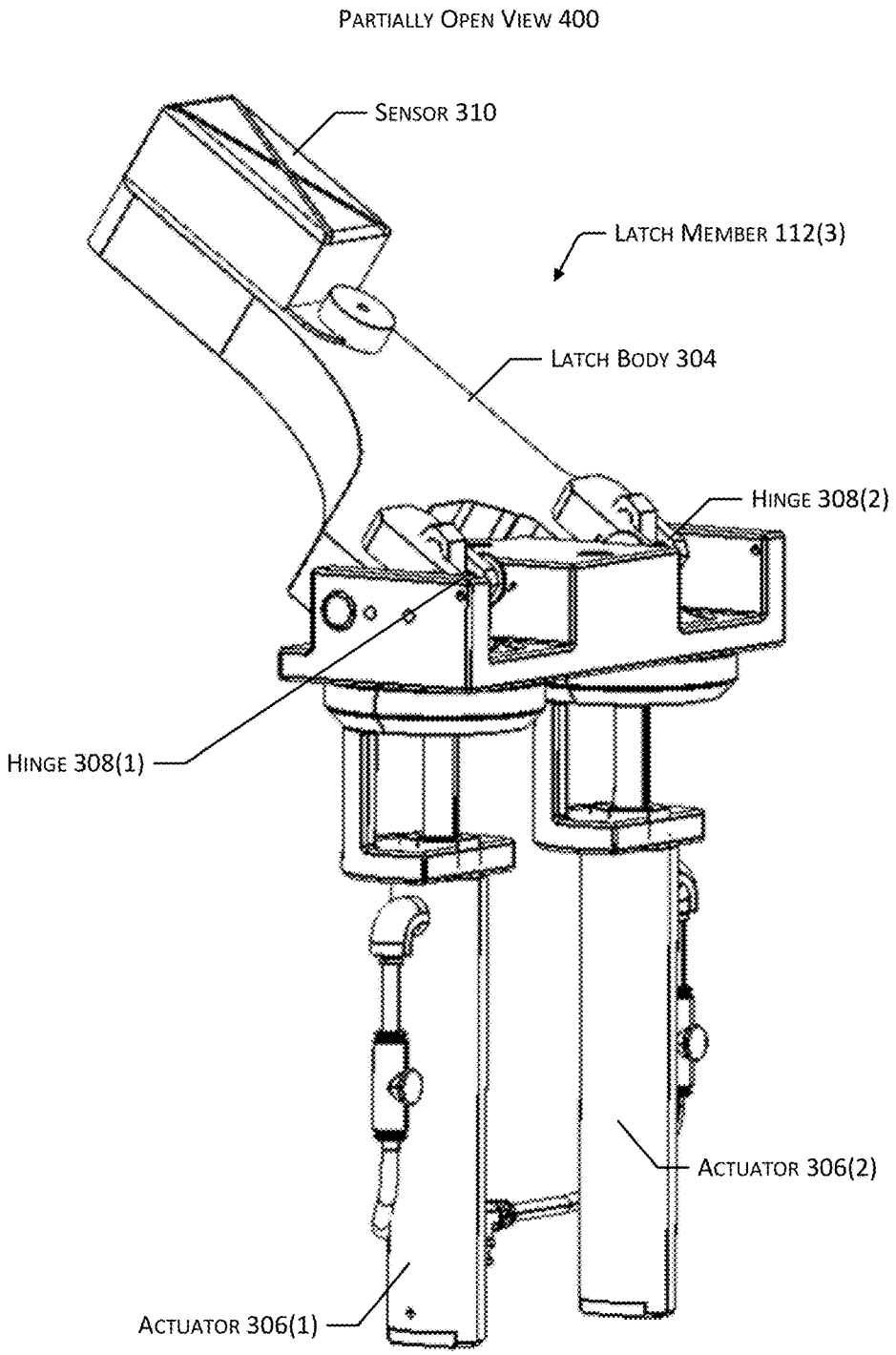
FIG. 4 depicts a partially open view of an implementation of a latch member.

FIG. 4 depicts a partially open view 400 of an implementation of a latch member 112. In some cases, such as when a latch member 112(3) is damaged or obstructed, the latch body 304 may fail to move from the closed position to the open position but may move only partially toward the open position. In other cases, such as when the actuator(s) 306 or other pneumatic components associated with the latch member 112(3) are subject to a leak, the latch body 304 may move toward the closed position after reaching the open position. In such cases, the latch body 304 may be positioned in a partially open position relative to the remainder of the latch member 112(3). For example, FIG. 4 depicts a partially open view 400 in which the latch body 304 is positioned at an approximately 45-degree angle relative to a horizontal plane defined at the top of the actuators 306. In other implementations, a partially-open latch member 112(3) may include a latch body 304 positioned at other angles relative to the horizontal plane.

In the partially open view 400 shown in FIG. 4, the position of the latch body 304 may at least partially obstruct an associated slot 110, such that attempting to move a pipe 200 longitudinally within the slot 110 may cause contact between the pipe 200 and the latch member 112, or another portion of the fingerboard structure 104. In such a case, if a tool that applies a large force, such as a pipe racker, is used to attempt to move the pipe 200, at least a portion of the applied force(s) may affect the latch member 112(3) or other portions of the fingerboard structure 104. If the latch member 112(3) or fingerboard structure 104 is damaged, the pipe 200, or one or more other pipes 200, may fall from the fingerboard structure 104, causing potentially catastrophic damage. The sensor 310 may be used to determine the angular position and rate of movement of the latch body 304. For example, in some implementations, the sensor 310 may cause a notification to be generated responsive to determining that the latch body 304 is positioned at a 45-degree angle, as shown in the partially open views 400, or other positions, such as a 70-degree angle. A pipe-moving operation may be ceased responsive to this notification. Responsive to the notification, a maintenance, repair, or replacement operation may be performed with regard to the affected latch member 112(3). In some implementations, correspondence between sensor data from the sensor 310 and commands used to move the latch body 304 may be determined. For example, if the latch body 304 moves toward the closed position independent of a command provided to the latch member 112(3), this may indicate that the latch body 304 is closing or falling toward the closed position due to a malfunction.

Figure 5:
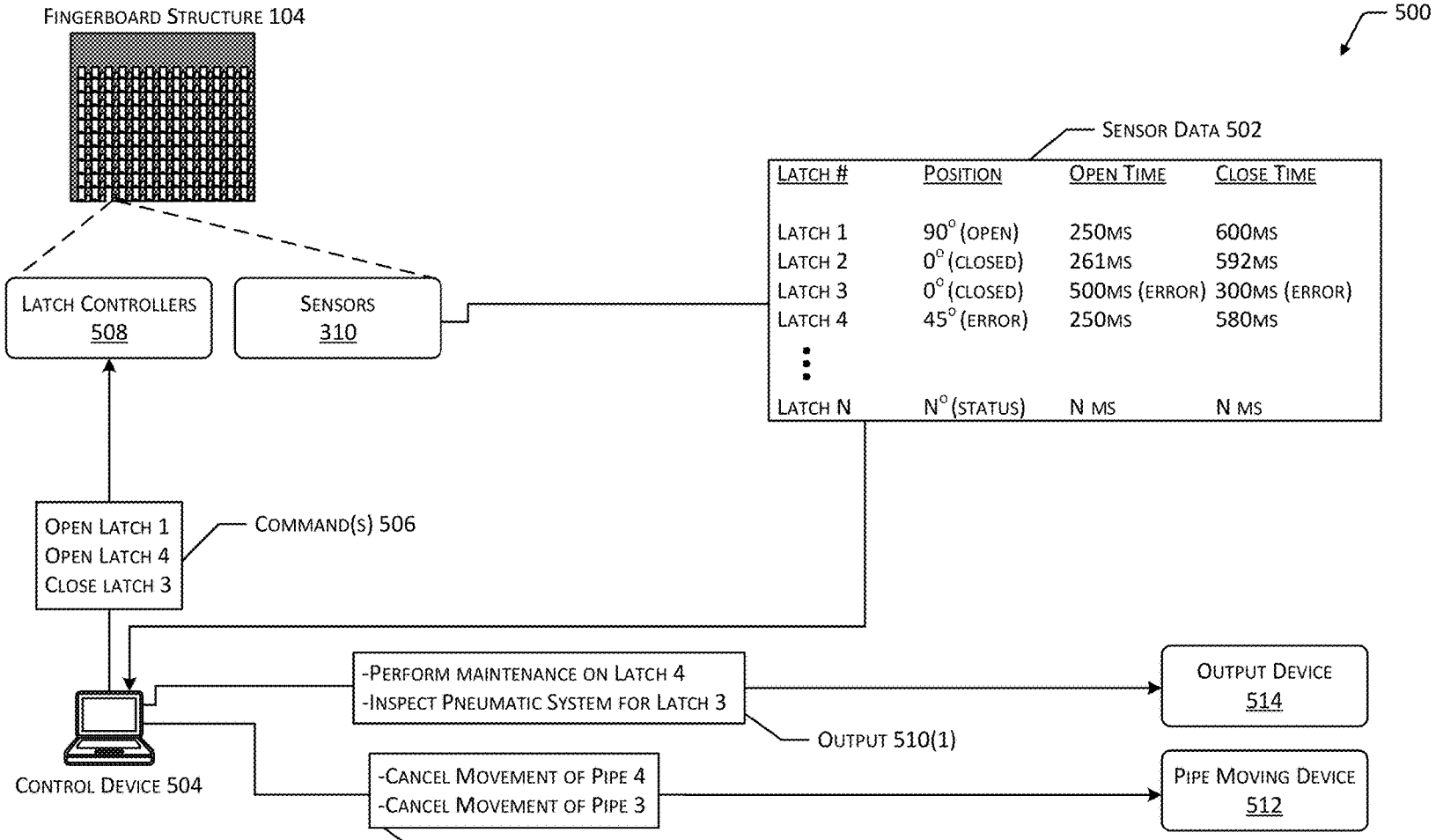
FIG. 5 depicts an implementation of a system for controlling latch members and pipe moving operations based on sensor data.

FIG. 5 depicts an implementation of a system 500 for controlling latch members 112 and pipe moving operations based on sensor data 502. A control device 504 may be used to provide commands 506 to the latch members 112 to cause the latch members 112 to move toward the open position or the closed position. The control device 504 may include any type of computing device, including without limitation a desktop computer, laptop computer, or other personal computer, a smartphone, tablet computer, wearable computer, or other portable computer or mobile device, an automotive computer, a set-top box, a server, and so forth. Additionally, while FIG. 5 depicts a single control device 504, multiple control devices 504 may be used to provide commands 506 to the latch members 112 and receive sensor data 502 from the sensors 310. For example, a first control device 504 may receive commands 506 and receive sensor data 502 from a first set of latch members 112, while a second control device 504 receives data from a second set of latch members 112. In other cases, multiple control devices 504 may be used to communicate with the same set of latch members 112 based on availability of bandwidth and computing resources.

A latch controller 508 associated with a latch member 112 may receive a command 506 from a system configured to operate the latch members 112, and one or more of the latch controller 508 or the control system for the latch members 112 may provide data indicative of the command 506 to the control device 504. For example, each latch controller 508 may have a unique identifier, such as an Internet Protocol, Media Access Control address, or another type of network identifier, a name or an alphanumeric designation, or other data that may be used to differentiate a particular latch member 112 from other latch members 112. A command 506 received by the control device 504 may include data indicative of an identifier associated with a particular latch member 112. One or more gateways or one or more devices associated with the network used by the control device 504 and latch members 112 may transmit the command 506 to the control device 504. In response to receiving a command 506, a latch controller 508 may cause a latch member 112 to move. For example, a command 506 may cause a latch member 112 to move from the closed position toward the open position or from the open position toward the closed position. In other implementations, commands 506 may cause latch members 112 to cease movement, output sensor data 502 indicative of a current or previous position or rate of movement, enter into a low power or dormant state, cease responding to commands 506, resume responding to commands 506, and so forth.

As described with regard to FIG. 3, each latch member 112 may have one or more sensors 310 associated therewith. The sensor(s) 310 may determine a current angular position of a latch member 112, a rate of movement of the latch member 112 toward the open position, a rate of movement of the latch member 112 toward the closed position, a frequency of vibration of a latch member 112 during movement, a temperature of a latch member 112, and so forth. For example, the sensor(s) 310 may generate sensor data 502 indicative of one or more of the angular position or rate(s) of movement of the latch member 112, which may be provided to the control device 504. Continuing the example, the sensor data 502 may indicate an angular position of a latch body 304 relative to a plane parallel to the fingerboard structure 104. The sensor data 502 may also indicate a first period of time that lapsed during movement of the latch body 304 from the open position to the closed position, and a second period of time that lapsed during movement of the latch body 304 from the closed position to the open position. In some implementations, the sensor data 502 may also indicate whether one or more values deviate from corresponding threshold values. For example, threshold values may include angular positions corresponding to the open and closed positions of a latch body 304, such as 90 degrees and zero degrees, respectively. If the angular position of the latch body 304 deviates from a threshold value by more than a threshold amount, such as five degrees, or a threshold percentage, such as five percent of the threshold value, this may indicate a possible malfunction associated with the corresponding latch member 112. As another example, threshold values may include expected time periods for a latch body 304 to achieve a closed position or an open position. Continuing the example, if a latch body 304 moves from the open position to the closed position in a period of time less than 500 milliseconds, this may indicate a malfunction in the latch member 112. If a latch body 304 moves from the closed position to the open position in a time greater than 270 milliseconds, this may indicate a malfunction.

Based on correspondence between the sensor data 502 and latch function data that may indicate one or more threshold values, the control device 504 may generate an output 510. In some cases, the output 510 may include notifications that may be intended to cause other devices, such as a pipe moving device 512, to commence, continue, or cease a particular operation. For example, responsive to sensor data 502 indicating that a latch member 112 has not properly reached the open position, output 510(1) from the control device 504 may cause the pipe moving device 512 to automatically cancel an operation to move a pipe 200 that corresponds to the latch member 112, or inform a user responsible for the pipe moving device 512 so that the user may manually cancel the pipe moving operation. As another example, responsive to sensor data 502 indicating that a latch member 112 is reaching the closed position more quickly than a threshold rate or is reaching the open position more slowly than a threshold rate, the control device 504 may provide output 510(1) that may be intended to cause the pipe moving device 512 to cancel an operation to move a pipe 200 that corresponds to the latch member 112. In cases where the sensor data 502 may indicate that inspection, repair, replacement, or maintenance of a latch member 112 is warranted, the control device 504 may generate output 510(2), such as an alert, alarm, or notification, which may be provided to an output device 514, such as a display associated with the control device 504 or a system for controlling the latch members 112. In other implementations, one or more devices receiving the output 510(2) may be configured to automatically initiate maintenance or diagnostic functions with regard to particular latch members 112. For example, in response to the output 510(2), a latch controller 508 may cause a latch member 112 to enter into a low power or diagnostic state.

Figure 6:
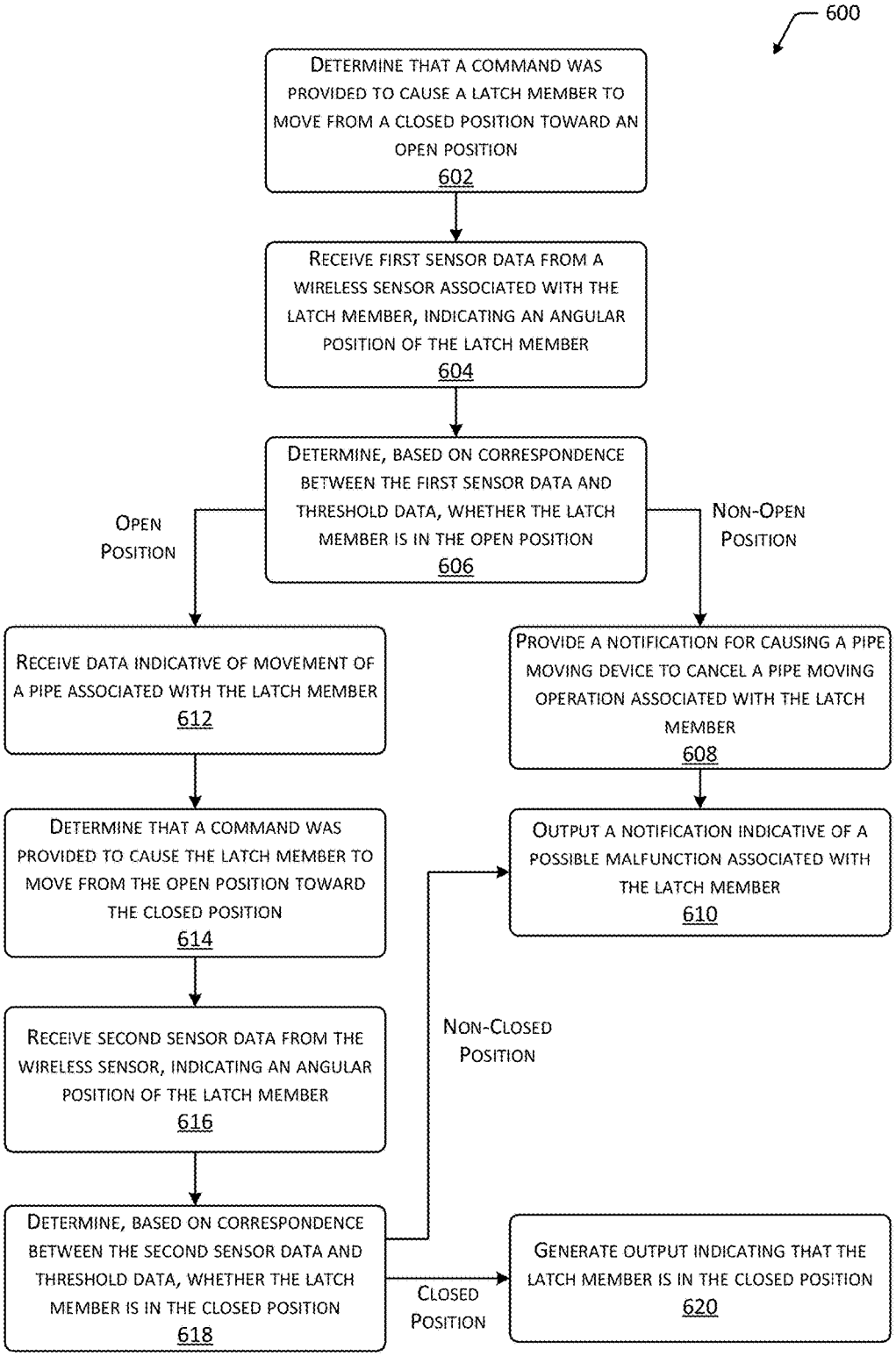
FIG. 6 is a flow diagram illustrating a method for confirming the angular position of a latch member based on wireless sensor data.

FIG. 6 is a flow diagram 600 illustrating a method for confirming the angular position of a latch member 112 based on wireless sensor data 502. At 602, a command 506 that was provided to cause a latch member 112 to move from a closed position toward an open position may be determined. As described with regard to FIG. 5, multiple latch members 112 of a fingerboard structure 104 may each be associated with a respective identifier. The command 506 may be received by a control device 504 associated with the sensors 310 and may indicate the identifier of a particular latch member 112.

At 604, first sensor data 502 may be received from a wireless sensor 310 associated with the latch member 112. The sensor data 502 may indicate an angular position of the latch member 112. For example, if the latch member 112 functions properly and achieves the open position, the sensor data 502 may indicate an angular position of 90 degrees relative to a horizontal plane of the fingerboard structure 104. If the latch member 112 does not function, moves toward the closed position after opening, or does not properly receive or process the command 506, the latch member 112 may remain in the closed position, and the sensor data 502 may indicate an angular position of zero degrees relative to the horizontal plane. If the latch member 112 moves only a portion of the distance toward the open position or closes at least partially after reaching the open position, the sensor data 502 may indicate an angular position between the angular positions corresponding to the open and closed positions.

At 606, correspondence between the first sensor data 502 and threshold data may be determined. The threshold data may indicate one or more angular positions that correspond to the open position of the latch member 112. Correspondence between the sensor data 502 and threshold data may therefore indicate whether the latch member 112 is positioned in the open position, or in a different position.

If the sensor data 502 deviates from the threshold data by at least a threshold amount, such as five degrees, this may indicate that the latch member 112 is not in the open position and that the latch member 112 may potentially be subject to a malfunction. In such a case, an attempt to move a pipe 200 associated with the latch member 112 may be unsuccessful and may cause damage. Therefore, if the sensor data 502 indicates that the latch member 112 is not in the open position, at 608, a notification may be provided for causing a pipe moving device 512 to cancel a pipe moving operation associated with the latch member 112. For example, a pipe moving device 512 may be configured to automatically cancel a pipe moving operation responsive to a notification, or an operator associated with the pipe moving device 512 may refrain from attempting to move a pipe 200 responsive to the notification. Additionally, at 610, a notification indicative of a possible malfunction associated with the latch member 112 may be output. In some implementations, the notification may be configured to cause an automatic process to diagnose possible sources of malfunction associated with the latch member 112. For example, the notification may cause automatic testing of a pneumatic system, electrical system, or network connection associated with a latch member 112. In other implementations, the notification may be output to an output device 514 for manual review by a human operator.

If it is determined at 606 that the sensor data 502 corresponds to the threshold data, then at 612, data indicative of movement of a pipe 200 associated with the latch member 112 may be determined. For example, a control device 504 associated with the sensors 310 may receive data indicative of a command 506 provided to the pipe moving device 512. When a latch member 112 is in the open position, the latch member 112 may not obstruct a slot 110 in the fingerboard structure 104 in a manner sufficient to prevent passage of a pipe 200 past the latch. Therefore, a pipe moving operation may move a pipe 200, longitudinally within the slot 110, past the latch member 112. The pipe moving operation may include removing one or more pipes 200 from the slot 110 or placing one or more pipes 200 within the slot 110.

At 614, subsequent to the pipe moving operation, a command 506 that was provided to cause the latch member 112 to move from the open position toward the closed position may be determined. At 616 second sensor data 502 from the wireless sensor 310 may be received, which may indicate the angular position of the latch member 112. At 618, correspondence between the second sensor data 502 and the threshold data may be determined, which may indicate whether the latch member 112 is in the closed position.

If the second sensor data 502 deviates from the threshold data by at least a threshold amount, indicating that the latch member 112 did not properly reach the closed position, the method may proceed to block 610, which may output a notification indicative of a possible malfunction associated with the latch member 112. If the second sensor data 502 corresponds to the threshold data, indicating that the latch member 112 properly reached the closed position, at 620, output 510 indicating that the latch member 112 is in the closed position may be generated.

Figure 7:
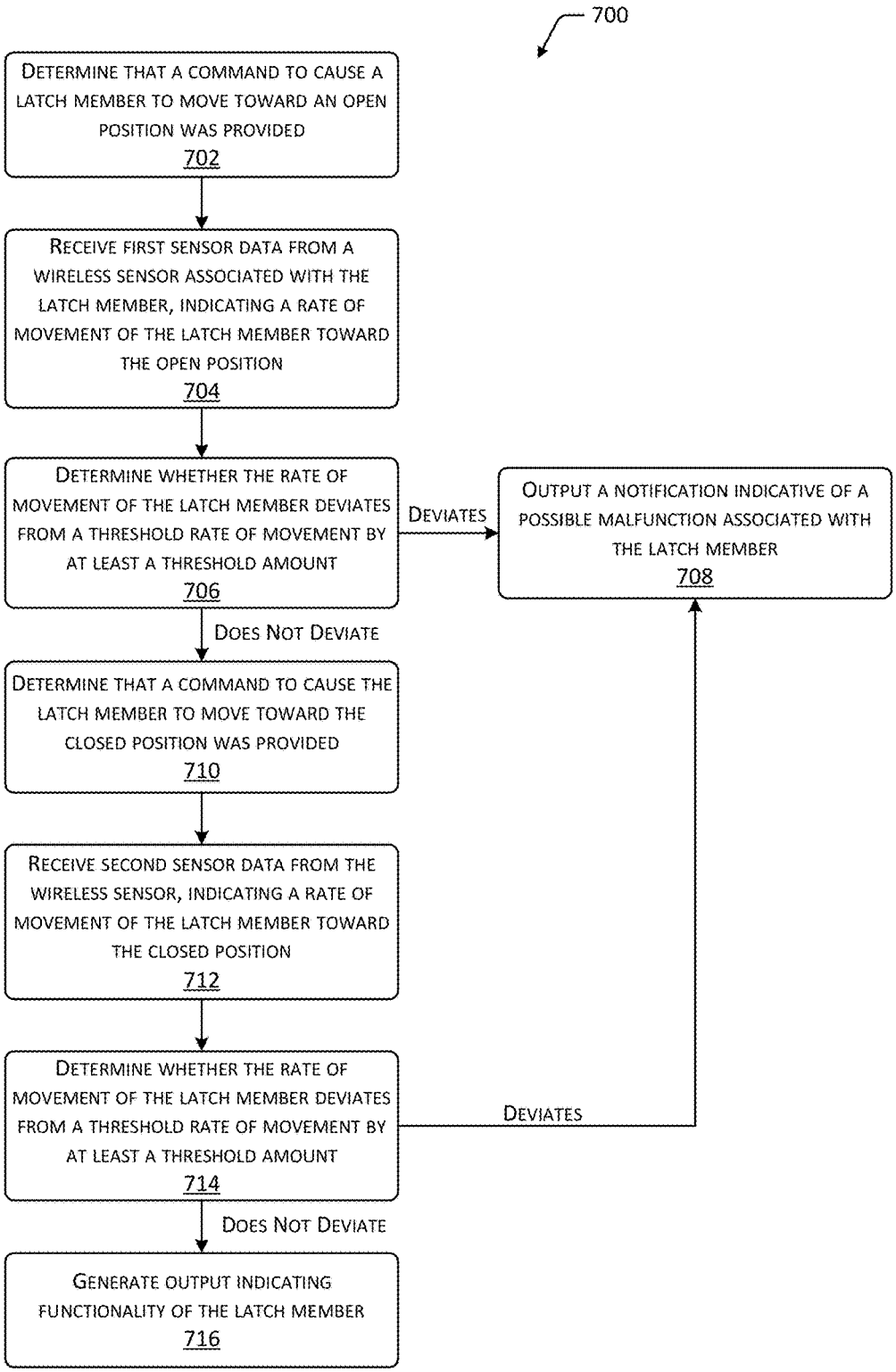
FIG. 7 is a flow diagram illustrating a method for determining the rate of movement of a latch member based on wireless sensor data.

FIG. 7 is a flow diagram 700 illustrating a method for determining the rate of movement of a latch member 112 based on wireless sensor data 502. At 702, a command 506 to cause a latch member 112 to move toward an open position may be determined. As described with regard to FIGS. 5 and 6, a received command 506 may indicate an identifier associated with a particular latch member 112, which may be received from a latch controller 508 or other system component for interacting with the latch members 112.

At 704, first sensor data 502 may be received from a wireless sensor 310 associated with the latch member 112. The first sensor data 502 may indicate a rate of movement of the latch member 112 toward the open position. In some implementations, the rate of movement may include one or more of an angular velocity, acceleration, or a quantity of time that elapsed before the latch member 112 reached the open position or ceased movement.

At 706, correspondence between the rate of movement of the latch member 112 and a threshold rate of movement may be determined. If the rate of movement of the latch member 112 deviates from the threshold rate by at least a threshold amount, then at 708, a notification indicative of a possible malfunction associated with the latch member 112 may be output. For example, if a pneumatic system associated with a latch member 112 is affected by a leak or otherwise damaged, or if one or more portions of the latch member 112 are damaged, the latch member 112 may move toward the open position more slowly than an expected rate of movement indicated by the threshold value. In some cases, the reduced rate of movement associated with the latch member 112 may cause the latch member 112 to fail to reach the open position, or to fail to reach the open position prior to initiation of an operation to move a pipe 200 associated with the latch member 112. As such, responsive to the notification, in some implementations, one or more pipe moving operations associated with the latch member 112 may be canceled.

If the rate of movement of the latch member 112 does not deviate from the threshold rate by at least a threshold amount, at 710, a command 506 provided to cause the latch member 112 to move toward the closed position may be determined. For example, the command 506 may be provided subsequent to completion of an operation to move a pipe 200 into or from a slot 110 associated with the latch member 112.

At 712, second sensor data 502 from the wireless sensor 310 may be received, indicating a rate of movement of the latch member 112 toward the closed position. At 714, correspondence between the rate of movement of the latch member 112 toward the closed position and a threshold rate of movement may be determined. The threshold rate of movement associated with movement toward the closed position may differ from the threshold rate associated with movement toward the open position. For example, a latch member 112 may be expected to move from the closed position to the open position in 250 milliseconds, and from the open position to the closed position in 600 milliseconds. Block 712 may determine whether the rate of movement of the latch member 112 toward the closed position deviates from the threshold rate by at least a threshold amount.

If the rate of movement of the latch member 112 deviates from the threshold rate by at least the threshold amount, the method may proceed to block 708, which may output a notification indicative of a possible malfunction associated with the latch member 112. If the rate of movement of the latch member 112 does not deviate from the threshold rate by at least the threshold amount, at 716, output 510 indicating the functionality of the latch member 112 may be output. For example, the output 510 may indicate a useable life expectancy of the latch member 112 based on the determined rates of movement.

Figure 8:
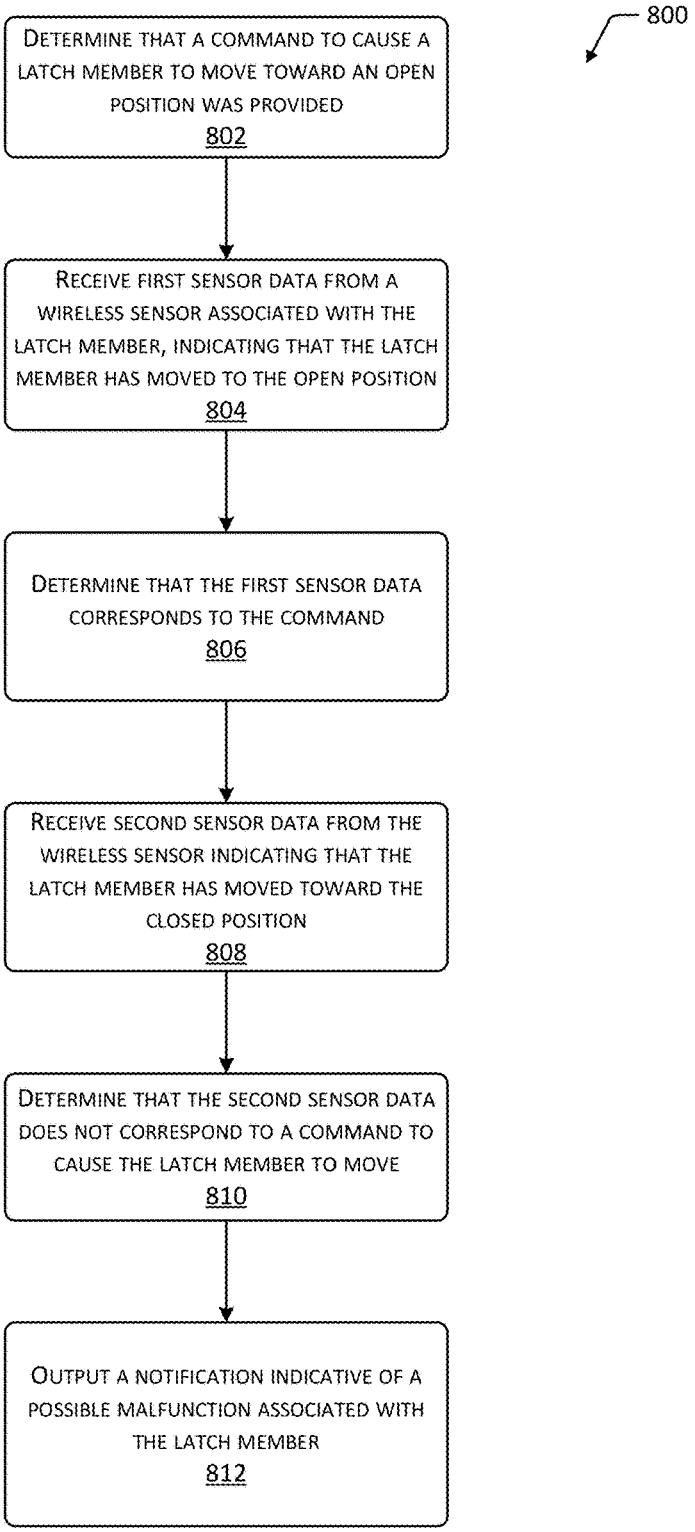
FIG. 8 is a flow diagram illustrating a method for determining whether movement of a latch member corresponds to a command to cause the latch member to move.

FIG. 8 is a flow diagram 800 illustrating a method for determining whether movement of a latch member 112 corresponds to a command 506 to cause the latch member 112 to move. At 802, a command 506 that is provided to cause a latch member 112 to move toward an open position may be determined. At 804, first sensor data 502 may be received from a wireless sensor 310 associated with the latch member 112. The sensor data 502 may indicate that the latch member 112 has moved to the open position.

At 806, correspondence between the first sensor data 502 and the command 506 may be determined. For example, the sensor data 502 may correspond to the command 506 if the sensor data 502 and command 506 are associated with the same latch member 112, and the movement of the latch member 112 is associated with the same direction and position as the position indicated in the command 506, within a threshold tolerance.

At 808, second sensor data 502 may be received from the wireless sensor 310. The second sensor data 502 may indicate that the latch member 112 has moved toward the closed position. In some cases, movement of the latch member 112 may be associated with a command 506 to move the latch member 112. However, in other cases, movement of the latch member 112 may be caused by a possible malfunction, such as a leak in a pneumatic component. At 810, a lack of correspondence between the second sensor data 502 and a command 506 to cause the latch member 112 to move may be determined. For example, if a latch member 112 falls toward the closed position in the absence of a command 506, this may indicate a possible malfunction.

At 812, a notification indicative of a possible malfunction of the latch member 112 may be output. In some cases, a pipe-moving operation associated with the latch member 112 may be canceled responsive to the notification. For example, if a latch member 112 moves toward the closed position in the absence of a command 506 to do so, this may indicate that the latch member 112 has closed prior to completion of a pipe moving operation. Cessation of the operation after determining the movement of the latch member 112 may prevent damage to a pipe 200, latch member 112, fingerboard structure 104, human operator, or other equipment. A notification may be used to cause repair, replacement, maintenance, or inspection of the latch member 112. In some implementations, one or more of a repair, replacement, maintenance, or inspection operation may be performed automatically responsive to a lack of correspondence between the command 506 and the sensor data 502.

Figure 9:
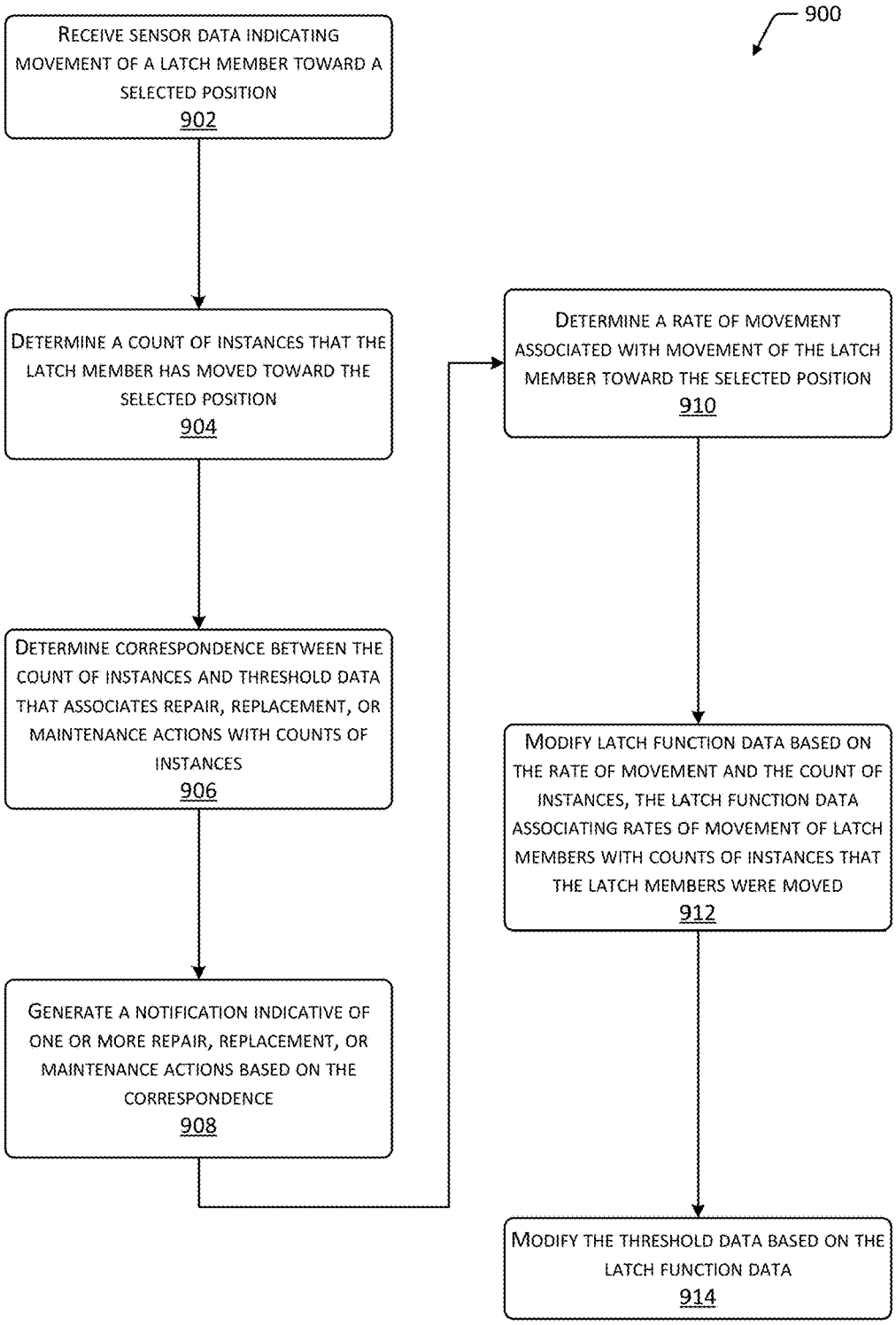
FIG. 9 is a flow diagram illustrating a method for determining and monitoring the condition of a latch member over time.

FIG. 9 is a flow diagram 900 illustrating a method for determining and monitoring the condition of a latch member 112 over time. At 902, sensor data 502 indicating movement of a latch member 112 toward a selection position may be received. The sensor data 502 may be associated with movement of the latch member 112 toward the open position, the closed position, or another position.

At 904, a count of instances that the latch member 112 has moved toward the selected position may be determined. For example, on each instance that a particular latch member 112 moves toward the open position, a count of instances associated with movement of that latch member 112 may be increased by one. The count of instances may be stored in association with an identifier indicative of the particular latch member 112.

At 906, correspondence between the count of instances and threshold data that associates repair, replacement, or maintenance actions with counts of instances may be determined. For example, threshold data may indicate that after a latch member 112 has been moved toward the open position one thousand times, lubrication of the hinges 302 of the latch member 112 is recommended, and after the latch member 112 has been moved toward the open position two thousand times, replacement of a battery associated with the latch member 112 is recommended. At 908, a notification indicative of one or more repair, replacement, or maintenance actions may be generated based on the correspondence determined at 906.

In some implementations, threshold data may be determined based on previous behaviors of latch members 112 over time. For example, at 910, a rate of movement associated with movement of the latch member 112 toward the selected position may be determined. At 912, latch function data associated with the latch member 112 may be modified based on the rate of movement. For example, the latch function data may associate rates of movement of latch members 112 with counts of instances that the latch members 112 were moved. Continuing the example, the latch function data may indicate an expected rate of movement of a latch member 112 toward the open position on the 1,172nd instance that the latch member 112 was moved toward the open position. In some implementations, the expected rate of movement may be determined based on an average rate of movement of one or more latch members 112 at a selected count of instances. In other implementations, the latch function data may be used to estimate a usable life of a latch member 112 and to determine a potential malfunction of the latch member 112 based on the rate of movement thereof. For example, if the rate of movement of a latch member 112 on the 776th instance that the latch member 112 was moved deviates from the average rate of movement of a latch member 112 on the 776th instance of movement by more than a threshold value, this may indicate that the latch member 112 is damaged or is otherwise degrading more rapidly than expected. At 914, threshold data may be modified based on the latch function data. For example, if the expected rate of movement of a latch member after a selected count of instances of movement changes based on the latch function data, the threshold data may be updated to reflect the modified latch function data.

Figure 10:
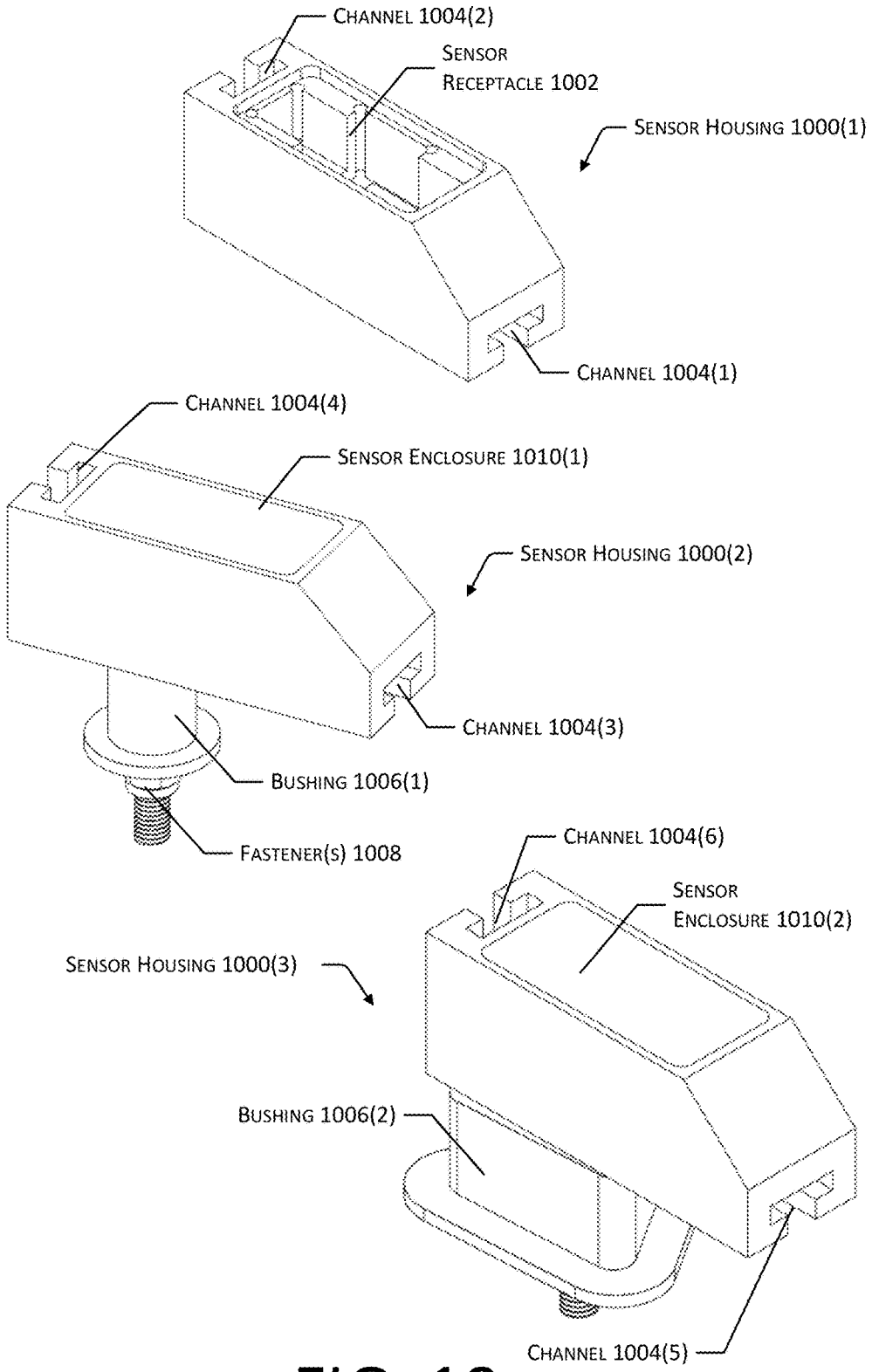
FIG. 10 depicts implementations of a sensor housing and features for attaching the sensor housing to a latch member.

FIG. 10 depicts implementations of a sensor housing 1000 and features for attaching the sensor housing 1000 to a latch member 112. A first implementation of sensor housing 1000(1) is shown having a generally rectangular shape, however, in other implementations, other shapes having dimensions sufficient to accommodate sensor components, a power source, and so forth may be used. The sensor housing 1000(1) includes a sensor receptacle 1002 that may contain a circuit board or other sensor components, a battery or another type of power source, and other components configured for operation of the sensor 310. After placement of sensor components within the sensor receptacle 1002, the sensor receptacle 1002 may be enclosed in a manner that protects the sensor components from ambient conditions. In some implementations, the sensor housing 1000(1) may be an intrinsically safe or explosion-proof enclosure for use in potentially hazardous environments. For example, sensor components and power sources may be sealed in the sensor receptacle 1002 by filling the sensor receptacle 1002 with epoxy or another type of resin or polymer. The sensor housing 1000(1) may include a first channel 1004(1) formed along a lower edge thereof for engagement with a bushing 1006 or other mounting structure for engagement with a latch member 112. In other implementations, a portion of the latch member 112, itself, may engage the channel 1004(1). In still other implementations, the sensor housing 1000(1) may instead engage a latch member 112 through use of a magnet. For example, a latch member 112 may lack an orifice for engaging a bushing 1006 or other feature extending from the sensor housing 1000, the first channel 1004(1) may be omitted, and a neodymium magnet may be positioned on the lower edge of the sensor housing 1000(1). A second channel 1004(2) formed in a side edge of the sensor housing 1000(1) may engage a bracket or other supporting structure to further prevent movement of the sensor housing 1000(1) relative to a latch member 112.

A second implementation of a sensor housing 1000(2) is shown engaged with a generally cylindrical bushing 1006(1) that may be positioned within a sensor receptacle 312 formed in a latch member 112. For example, FIG. 3 depicts a sensor receptacle 312, formed in the latch body 304 of a latch member 112, that has a generally cylindrical shape. The bushing 1006(1) may be positioned in the sensor receptacle 312 such that a flange or fastener thereof, such as a carriage bolt, protrudes from an upper end of the bushing 1006(1). The protruding member of the bushing 1006(1) may engage the channel 1004(3) formed in the lower end of the sensor housing 1000(2). When one or more fasteners 1008, such a nut, is tightened to urge the bushing 1006(1) against the lower end of the sensor housing 1002(2), the carriage bolt or similar fattener engaged in the channel 1004(3) may be tightened, securing the sensor housing 1000(2) in a generally fixed orientation relative to the latch member 112. In addition to or in place of securing the sensor housing 1000(2) using the channel 1004(3), an additional channel 1004(4) formed in a side wall of the sensor housing 1000(2) may be used to limit movement of the sensor housing 1000(2) relative to a latch member 112. The sensor enclosure 1010(1) may contain sensor components, power sources, and the like.

A third implementation of a sensor housing 1000(3) is shown engaged with a triangular bushing 1006(2), which may be positioned within a latch body 304 having triangular openings. Seating a non-round bushing 1006(2) within a non-round orifice may prevent rotational movement of the bushing 1006(2) and attached sensor housing 1000(3) relative to the latch member 112. The triangular bushing 1006(2) may be secured to the sensor housing 1000(3) via a channel 1004(5), using one or more fasteners 1008, in a manner similar to that described with regard to the round bushing 1006(1). In some cases, a channel 1004(6) formed in a side surface of the sensor housing 1000(3) may be used to secure the sensor housing 1000(3) in addition to or in place of the channel 1004(5) formed in the lower surface thereof. The sensor enclosure 1010(2) may contain sensor components, power sources, and so forth.

Those having ordinary skill in the art will readily recognize that certain steps or operations illustrated in the figures above may be eliminated, combined, or performed in an alternate order. Any steps or operations may be performed serially or in parallel. Furthermore, the order in which the operations are described is not intended to be construed as a limitation.

Additionally, those having ordinary skill in the art will readily recognize that the techniques described above can be utilized in a variety of devices, environments, and situations. Although the subject matter has been described in language specific to structural features or methodological acts, it is to be understood that the subject matter defined in the appended claims is not necessarily limited to the specific features or acts described. Rather, the specific features and acts are disclosed as example forms of implementing the claims.

What is claimed is:

1. A method comprising:

receiving first wireless sensor data from a sensor associated with a latch member, wherein the latch member is configured to move between an open position and a closed position;

determining, based on the first wireless sensor data, a first rate of movement associated with movement of the latch member toward the open position;

determining first correspondence between the first rate of movement and a first threshold rate of movement; and generating output indicative of the first correspondence.

2. The method of claim 1, wherein determining the first correspondence includes determining correspondence between the first rate of movement and latch function data that associates the first threshold rate of movement with one or more of a functionality or a life expectancy of the latch member, and wherein the output includes an indication of the one or more of the functionality or the life expectancy.

3. The method of claim 1, further comprising:

determining, based on one or more of the first wireless sensor data or second wireless sensor data, one or more of a temperature or a frequency of vibration associated with movement of the latch member;

determining second correspondence between the one or more of the temperature and the frequency and a threshold value indicative of normal operation of the latch member; and including, in the output, an indication of the second correspondence.

4. The method of claim 1, further comprising:

receiving second wireless sensor data from the sensor;

determining, based on the second wireless sensor data, an angular position of the latch member;

determining second correspondence between the angular position and the open position; and providing data indicative of the second correspondence to a system configured to cause movement of an object relative to the latch member.

5. The method of claim 1, further comprising:

receiving second wireless sensor data from the sensor;

determining, based on the second wireless sensor data, a second rate of movement associated with movement of the latch member toward the closed position;

determining second correspondence between the second rate of movement and one or more of the first threshold rate of movement or a second threshold rate of movement; and including, in the output, an indication of the second correspondence.

6. The method of claim 1, further comprising:

determining movement of the latch member toward the closed position;

determining that the movement is not associated with a command to cause movement of the latch member; and providing data indicative of a malfunction of the latch member to a system configured to cause movement of an object relative to the latch member.

7. The method of claim 1, further comprising:

causing the sensor to enter a low power state;

determining movement of the latch member that exceeds a threshold movement; and transitioning the sensor from the low power state to an active state for transmitting data.

8. A method comprising:

receiving first wireless sensor data from a sensor associated with a latch member, wherein the latch member is configured to move between an open position and a closed position;

determining, based on the first wireless sensor data, a first rate of movement associated with movement of the latch member toward the closed position;

determining first correspondence between the first rate of movement and a threshold rate of movement; and generating output indicative of the first correspondence.

9. The method of claim 8, further comprising:

determining, based on one or more of the first wireless sensor data or second wireless sensor data, one or more of a temperature or a frequency of vibration associated with the latch member;

determining second correspondence between the one or more of the temperature or the frequency and a threshold value indicative of normal operation of the latch member; and including, in the output, an indication of the second correspondence.

10. The method of claim 8, further comprising:

determining, based on one or more of the first wireless sensor data or second wireless sensor data, an angular position of the latch member;

determining second correspondence between the angular position and the open position; and including data indicative of the second correspondence in the output.

11. The method of claim 10, wherein the sensor includes a camera, the one or more of the first wireless sensor data or the second wireless sensor data includes image data acquired by the camera, and the angular position is determined at least in part using the image data.

12. The method of claim 8, wherein the sensor includes a camera associated with the latch member, the first wireless sensor data includes image data acquired by the camera, and the first rate of movement is determined at least in part using the image data.

13. The method of claim 8, further comprising:

positioning the latch member at a threshold angular position, wherein the sensor is configured to remain in a low power state when the latch member is in the threshold angular position;

transporting the latch member while the latch member is in the threshold angular position; and causing the latch member to move toward one of the open position or the closed position, wherein the sensor is configured to transition from the low power state to an active state for transmitting data after a lapse of a threshold period of time in a position other than the threshold angular position.

14. The method of claim 8, further comprising:

causing the sensor to enter a low power state;

determining movement of the latch member that exceeds a threshold distance; and in response to the movement exceeding the threshold distance, causing the sensor to transition to an active state for transmitting the first wireless sensor data.

15. A system comprising:

a structure including a latch member, wherein the latch member is moveable between a closed position and an open position;

a controller for monitoring the latch member;

a sensor associated with the latch member, wherein the sensor is in wireless communication with the controller;

one or more memories in communication with the controller and storing computer-executable instructions; and one or more hardware processors associated with the controller to execute the computer-executable instructions to:

receive first wireless sensor data from the sensor;

determine, based on the first wireless sensor data, a first rate of movement associated with movement of the latch member;

determine first correspondence between the first rate of movement a threshold rate of movement; and generate output indicative of the first correspondence.

16. The system of claim 15, further comprising computer-executable instructions to determine a direction associated with the movement of the latch member, and wherein the computer-executable instructions to determine the first correspondence include computer-executable instructions to determine correspondence between the first rate of movement and latch function data that associates the direction with one or more of a functionality or a life expectancy of the latch member.

17. The system of claim 15, further comprising computer-executable instructions to:

receive second wireless sensor data from the sensor;

determine, based on the second wireless sensor data, an angular position of the latch member;

determine second correspondence between the angular position and the open position; and provide an indication of the second correspondence to a system configured to move an object relative to the latch member.

18. The system of claim 15, further comprising computer-executable instructions to:

receive second wireless sensor data from the sensor;

determine, based on the second wireless sensor data, one or more of a temperature or a frequency of vibration associated with movement of the latch member;

determine second correspondence between the one or more of the temperature or the frequency and a threshold value indicative of normal operation of the latch member; and include, in the output, an indication of the second correspondence.

19. The system of claim 15, further comprising computer-executable instructions to:

cause the sensor to enter a low power state;

determine movement of the sensor that exceeds a threshold distance; and cause the sensor to transition to an active state for transmitting data to the controller.

20. The system of claim 15, further comprising computer-executable instructions to:

determine movement of the latch member not associated with a command to cause the movement; and provide an indication of a malfunction of the latch member to a system configured to move an object relative to the latch member.

* * * * *